United States Patent [19]

Lönnebring

[11] 4,302,165

[45] Nov. 24, 1981

[54] INTERENGAGING SCREW MACHINE WITH RADIAL INLET AND/OR OUTLET BORE

[75] Inventor: Arne Lönnebring, Älvsjö , Sweden

[73] Assignee: Imo-Industri AB, Sweden

[21] Appl. No.: 63,712

[22] Filed: Aug. 6, 1979

[30] Foreign Application Priority Data

Aug. 22, 1978 [SE] Sweden ..... 7808861

[51] Int. Cl.[3] ..... F03C 2/08; F04C 2/16

[52] U.S. Cl. ..... 418/197; 418/201

[58] Field of Search ..... 418/197, 201–203

[56] References Cited

U.S. PATENT DOCUMENTS

| | | | |
|---|---|---|---|
| 1,821,523 | 9/1931 | Montelius | 418/201 |
| 2,193,671 | 3/1940 | Dolza | 418/201 |
| 2,243,874 | 6/1941 | Lysholm | 418/201 |
| 3,437,263 | 4/1969 | Persson | 418/202 |
| 3,807,911 | 4/1974 | Caffrey | 418/201 |
| 4,078,653 | 3/1978 | Suter | 418/201 |

FOREIGN PATENT DOCUMENTS

| | | | |
|---|---|---|---|
| 753275 | 7/1956 | United Kingdom | 418/201 |

*Primary Examiner*—John J. Vrablik

*Attorney, Agent, or Firm*—Schuyler, Banner, Birch, McKie & Beckett

[57] ABSTRACT

The invention relates to hydraulic screw machines of the type having a screw array in a sealingly surrounding housing. The object of the invention is to reduce the length of the machine with unchanged number of seals in the screw array. This is achieved by providing at least one of the inlet and outlet openings to the screw array as a bore extending radially through the housing and in such a position that in at least some angular position of the screw array, it seals against the housing wall in the region which is within the axial extension of the opening.

2 Claims, 6 Drawing Figures

INTERENGAGING SCREW MACHINE WITH RADIAL INLET AND/OR OUTLET BORE

Figure 1:
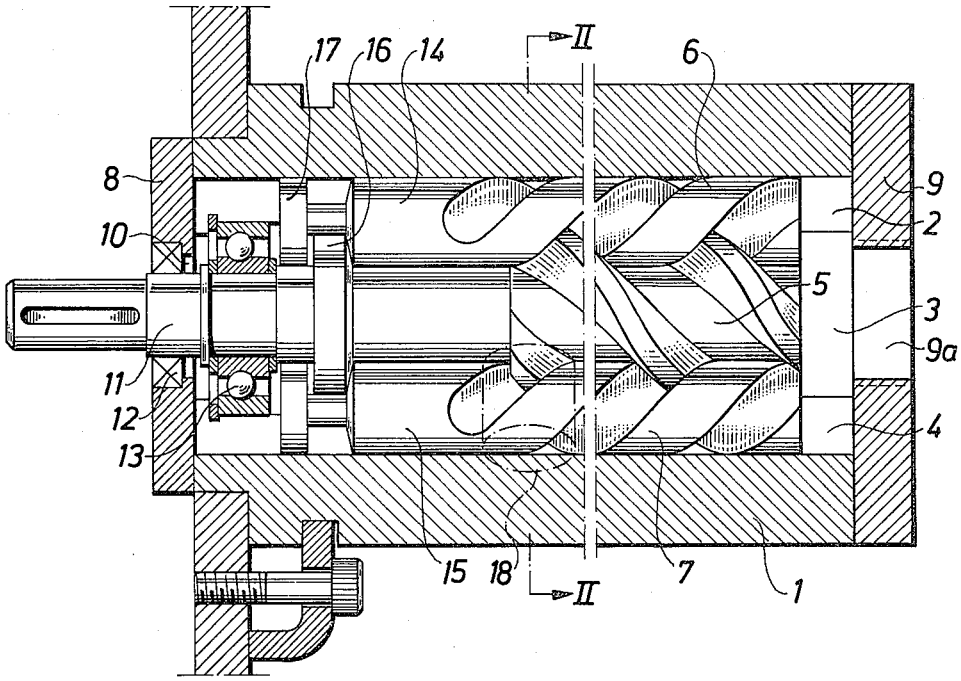

The present invention relates to hydraulic screw machines comprising a screw array in the form of a driving screw and at least one running screw mating therewith, enclosed in a housing, the screws and housing being made to seal against each other such that for every angular position of the screws, at least one complete seal is present between the inlet and outlet end of the screw array.

In such a machine, liquid is conveyed through the screw array in chambers closed off against each other, said chambers travelling along the screw array from the inlet end to the outlet end during rotation of the screws. Each chamber is first open to the inlet end so that liquid can flow into it, and is then closed by a complete seal being formed, to open at the outlet end of the screw array after a certain time. A new chamber has meanwhile been formed and sealed against the outlet end.

A machine of this kind can work as a pump, the driving screw then being connected to a driving motor. Liquid is then sucked in at the inlet end, and after conveying along the screw array it is discharged at the outlet end. The machine can also work as a motor, liquid being pumped into the inlet end of the screw array to drive it. In this case the driving screw is connected to an apparatus which is to be driven by the motor.

In order that the machine will work in the way intended, at least one complete seal must be present between either ends of the screw array. This results in that the screw array and housing must have a definite minimum length, which can be calculated from the dimensions of the screws.

It is usual to make the screw array and housing so that the flow is axial into and out of the screw array. It is thus required that a chamber is arranged at one end of the machine (the high pressure side), through which the driving screw shaft extends and to which a pipe or hose can be connected.

A simplified structure can be obtained if the opening made on the high-pressure side of the machine is made directly through the housing wall into the space occupied by the screws in the housing. The housing can thus extend with constant cross section past the ends of the screws, and the driving screw shaft together with bearings and sealings can be placed in said space in the housing. Furthermore, the effective housing length can extend past the opening by maintaining the sealing surfaces of the housing around the rim of the opening. This makes it possible to shorten the machine for the same effective screw length.

The opening can be made with its axis perpendicular to a plane containing the axes of the screws hereinafter referred to as the "screw plane" and situated in a plane through the driving screw shaft perpendicular to said screw plane. This opening is preferably made unsymmetrically in relation to the driving screw, however, by having its axis cut the screw plane at a point laterally displaced from the driving screw axis, and/or by having its axis form an angle less than 90° with the screw plane. By adopting this arrangement of the opening, it is possible to place it closer to the opposite end of the screw array than with a symmetric arrangement of the opening.

The angle to said screw plane can be at most 75°, e.g. 30°-60°. The lateral displacement of the intersection point can be 0.25 -0.75 times the diameter of the driving screw, for example.

The invention will now be described in detail while referring to the accompanying drawings.

Figure 2:
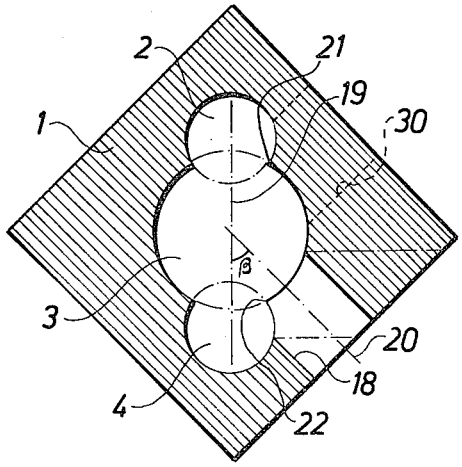
Figure 4:
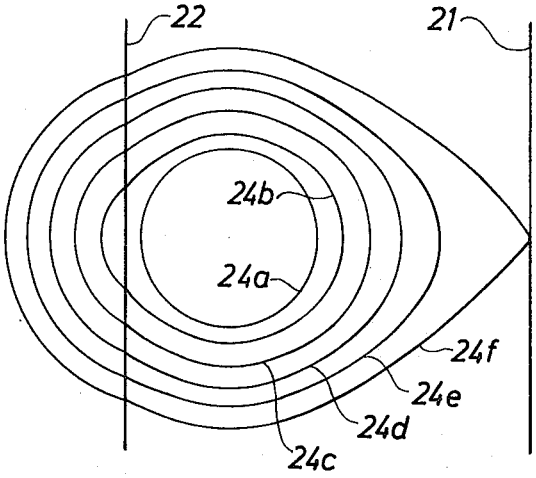
Figure 5:
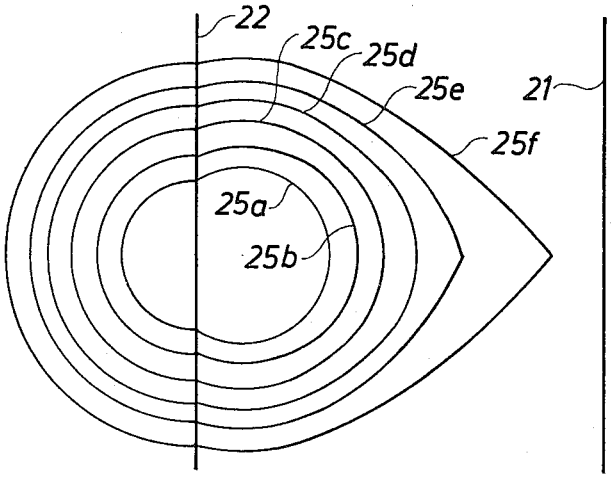
Figure 6:
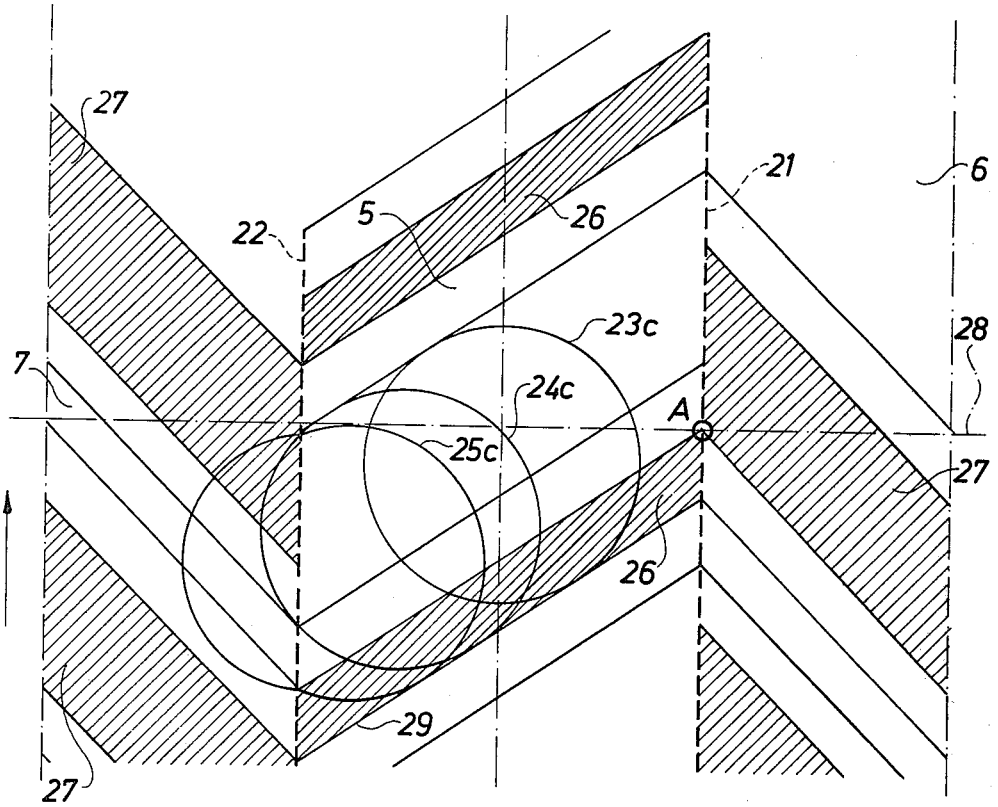

FIG. 1 is a longitudinal section of a screw pump in accordance with the invention, FIG. 2 is a section along the line II—II in FIG. 1, FIGS. 3, 4 and 5 illustrate the shape of the pump outlet opening, developed in one plane, for different positions and dimensions thereof, FIG. 6 is a section of the screw array developed in one plane.

The pump illustrated in FIGS. 1 and 2 comprises an elongate housing 1, having a longitudinal space in the form of three parallel, intersecting cylindrical bores 2, 3, 4, of which the middle one accommodates a driving screw 5 with convex threads, and both the outside ones each accommodate a running screw 6, 7 with concave threads mating with those of the driving screw, the diameters of the bores corresponding to the outer diameters of the screws, and the screw threads are formed so that they seal against each other.

The housing 1 is closed off at the ends by end plates 8, 9, attached to the housing in a way not more closely shown, and of which the former is provided with a central opening 10 through which a drive shaft 11 rigidly connected to the driving screw 5 extends for connection to a driving motor. A seal 12 is inserted between the shaft 11 and the opening 10. The shaft 11 is journalled by means of a ball bearing 13 inserted in a recess in the end of the housing 1. The screws are further formed with balancing pistons 14, 15, 16 and retaining washers 17 in a mode described in detail in the Swedish Patent Application No. 78 05824-5.

In the opposite end wall plate 9 there is a central opening 9*a* forming the pump inlet, and which is intended for connection to a supply pipe or hose. The pump outlet consists of a bore 18 through the housing 1, and in the example shown, it extends at an angle $\beta$ of 45° to a screw plane 19 with its axis 20 cutting this plane at the axis of the driving screw.

Figure 3:
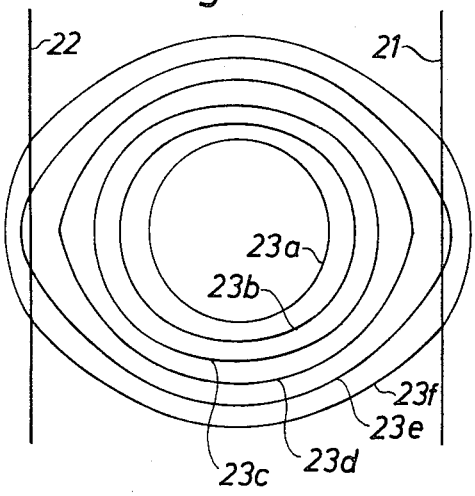

FIGS. 3, 4 and 5 illustrate the form of the intersection between the outlet opening 18 and the housing space for different bore diameters and different values of the angle $\beta$ between the axis of the bore and the screw plane, a plane development of the intersection being shown. In these figures, the edges 21, 22 formed between the housing bores 2, 3, 4 have been drawn in. It is assumed in all cases that the axis 20 of the outlet bore 18 intersects the screw plane 19 at the axis of the driving screw 5 (or of the bore 3).

FIG. 3 depicts the configuration of the rim of the outlet bore 18 for the case where the angle is 90°, i.e. bore extends perpendicular to the screw plane, The curves 23*a*-*f* depict said configuration for six different bore diameters. In this case the opening will be symmetric and elliptic. For the larger diameters (the curves 23*e* and *f*) where the opening extends to intersect the bores of the running screws, there is naturally a certain modification of the elliptical shape.

In FIG. 4 there are illustrated corresponding curves 24*a*-*f* for the case where the angle $\beta$ is 60°, the diameters of the curves having the same letter being the same as in FIG. 3. As will be seen, the curves are laterally displaced towards the edge 22, and intersect the running screw bore to a greater extent than in FIG. 3.

The curves 25*a–f* in FIG. 5 depict the configuration of the outlet bore rim when the angle 62 is 45°.

In FIG. 6, a plane development of half the screw array is illustrated (to the same scale as in FIGS. 3–5), i.e. the part which is visible in FIG. 1. The vertical lines 22 and 21 thus correspond to the position of the edges in FIGS. 3–5. The hatched areas 26 and 27 are the areas where the screws seal against the housing bore or space, i.e. the outer surfaces of the respective screw threads. Point A is the point where the leading edge of the driving screw thread intersects the housing edge 21. If the housing is terminated by a flat surface perpendicular to the axis of the driving screw, the chamber defined by the seals 27, 26, 27 will be open axially when this point A reaches the end of the housing (indicated by the line 28). When an outlet passage is made through the wall of the housing, as in the case intended here, this chamber is opened to the outlet when the trailing edge 29 of the screw thread is tangential to the contour of the outlet opening rim. In FIG. 6, the curves 23*c*, 24*c* and 25*c* have been drawn in positions such that they are tangential to the edge 29. It will be apparent from this that for the same diameter of the outlet opening, the nearer said opening is placed to the inlet end of the screw array, the smaller the angle which it forms with the screw plane, whereby the housing and thus the whole pump structure can be shortened while retaining the number of seals between the inlet and outlet.

As will be easily appreciated, the same effect can also be attained when using an outlet passage perpendicular to the screw plane, if this passage is displaced laterally in relation to the axis of the driving screw, i.e. placed so that its axis cuts the screw plane to one side of the axis of the driving screw. Both steps can naturally be combined.

It is also possible to make the inlet of the pump as a bore going through the housing in the same way as described above. In this case the bore could be placed as indicated at 30 in FIG. 2, for example, where it is perpendicular to the outlet, and at such an axial distance from the outlet that there is at least one complete seal between inlet and outlet for every angular position of the screws.

The invention is naturally applicable to hydraulic screw machines of the type intended here which are intended to work as motors.

I claim:

1. A hydraulic screw machine including:

a screw array in the form of a driving screw and at least one running screw coacting therewith;

a housing enclosing said screw array provided with inlet and outlet openings, said housing defining a cavity with said screws mounted in said cavity to seal against each other such that in every position of the screw array there is at least one complete seal between said inlet and outlet openings at the ends of the screw array;

one of said inlet and outlet openings being disposed at one end of said screw array and being provided by a bore extending radially from said cavity through said housing, said bore being circular in cross section with the axis of said bore forming an angle of less than 90 degrees with a plane containing the axes of said screws whereby said one opening can be disposed nearer to the other of said openings while retaining said at least one complete seal between said openings such that said housing and the overall screw machine can be shortened.

2. A hydraulic screw machine as recited in claim 1 wherein said bore axis cuts said plane to one side of the driving screw axis.

* * * * *